US009067752B2

(12) United States Patent
Bildstein et al.

(10) Patent No.: US 9,067,752 B2
(45) Date of Patent: Jun. 30, 2015

(54) FREQUENCY-BASED WEB STEERING IN PRINTING SYSTEMS

(71) Applicants: Carl R Bildstein, Lafayette, CO (US); Stuart J. Boland, Denver, CO (US); Scott R. Johnson, Erie, CO (US); Casey E. Walker, Boulder, CO (US)

(72) Inventors: Carl R Bildstein, Lafayette, CO (US); Stuart J. Boland, Denver, CO (US); Scott R. Johnson, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/933,663

(22) Filed: Jul. 2, 2013

(65) Prior Publication Data

US 2015/0009256 A1 Jan. 8, 2015

(51) Int. Cl.

| | |
|---|---|
| ***B65H 23/02*** | (2006.01) |
| ***B41J 29/38*** | (2006.01) |
| ***B65H 20/00*** | (2006.01) |
| ***B41J 15/04*** | (2006.01) |
| ***B65H 23/032*** | (2006.01) |

(52) U.S. Cl.

CPC ..... *B65H 20/00* (2013.01); *B41J 15/046* (2013.01); *B65H 23/032* (2013.01); *B65H 23/02* (2013.01)

(58) Field of Classification Search

CPC ..... B41J 15/046

See application file for complete search history.

(56) References Cited

U.S. PATENT DOCUMENTS

| | | | | |
|---|---|---|---|---|
| 3,114,489 | A * | 12/1963 | Legler | 226/15 |
| 4,961,089 | A * | 10/1990 | Jamzadeh | 399/165 |
| 6,164,201 | A * | 12/2000 | Burke | 101/228 |
| 6,701,837 | B2 | 3/2004 | Ohba et al. | |
| 7,583,920 | B2 | 9/2009 | Willemsens et al. | |
| 7,857,414 | B2 | 12/2010 | Eun et al. | |
| 8,328,315 | B2 | 12/2012 | Eun et al. | |
| 2001/0000065 | A1 * | 3/2001 | Kustermann | 162/252 |
| 2011/0024546 | A1 * | 2/2011 | Fuwa | 242/615.1 |
| 2011/0042437 | A1 * | 2/2011 | Sugie et al. | 226/15 |
| 2012/0223996 | A1 | 9/2012 | Ernst et al. | |
| 2012/0240803 | A1 * | 9/2012 | Sato et al. | 101/485 |
| 2013/0113857 | A1 | 5/2013 | Armbruster et al. | |
| 2013/0155140 | A1 * | 6/2013 | Calamita et al. | 347/19 |

* cited by examiner

*Primary Examiner* — Shelby Fidler

(74) *Attorney, Agent, or Firm* — Duft Bornsen & Fettig LLP

(57) ABSTRACT

Systems and methods are provided for predictively compensating for frequency-based shifts of the position of a web of print media in a continuous-forms printer. The system comprises a sensor and a controller. The sensor is able to detect lateral shifts of the web of print media traveling through the continuous-forms printer. The controller is able to identify a frequency of the lateral shifts of the web, and to steer the web based on the frequency.

24 Claims, 9 Drawing Sheets

LATERAL STEERING OVER TIME (PREDICTIVE)

FREQUENCY-BASED WEB STEERING IN PRINTING SYSTEMS

FIELD OF THE INVENTION

The invention relates to the field of printing systems, and in particular, to aligning webs of media for continuous-forms printing systems.

BACKGROUND

Entities with substantial printing demands typically use a production printer. A production printer is a high-speed printer used for volume printing (e.g., one hundred pages per minute or more). Production printers include continuous-forms printers that print on a web of print media stored on a large roll.

A production printer typically includes a localized print controller that controls the overall operation of the printing system, and a print engine (sometimes referred to as an "imaging engine" or a "marking engine"). The print engine includes one or more printhead assemblies, with each assembly including a printhead controller and a printhead (or array of printheads). An individual printhead includes multiple (e.g., hundreds of) tiny nozzles that are operable to discharge ink as controlled by the printhead controller. A printhead array is formed from multiple printheads that are spaced in series across the width of the web of print media.

While the printer prints, the web is quickly passed underneath the nozzles, which discharge ink onto the web at intervals to form pixels. In order to ensure that the web is consistently positioned underneath the nozzles, steering systems can be used to align the web laterally with respect to its direction of travel. For example, these steering systems can be calibrated when the printer is first installed. However, even when the web is aligned, fluctuations in the physical properties of the web (e.g., small micron-level variations along the edge of the web, lateral tension variation along the web, orientation of the fibers in the web, etc.) can cause the web to experience lateral shifts during printing. This means that printed output for a job can shift back and forth laterally across the pages of a document. Even though the individual shifts can be small (e.g., on the order of microns), the shifts can reduce print quality. For example, when multiple printheads are used by a printer to form a mixed color pixel, a small fluctuation in web position can cause one printhead to mark the correct physical location, while another printhead marks the wrong physical location. This distorts the final color of the pixel in the printed job.

SUMMARY

Embodiments described herein can analyze lateral shifts at a web of print media over time. Based on this data, the shifts can be modeled in the frequency domain. The web can then be predictively steered laterally to account for the frequency (or frequencies) at which the web naturally shifts during printing.

One embodiment is a system used to predictively compensate for frequency-based shifts of the position of a web of print media in a continuous-forms printer. The system comprises a sensor and a controller. The sensor is able to detect lateral shifts of the web of print media traveling through the continuous-forms printer. The controller is able to identify a frequency of the lateral shifts of the web, and to steer the web based on the frequency.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
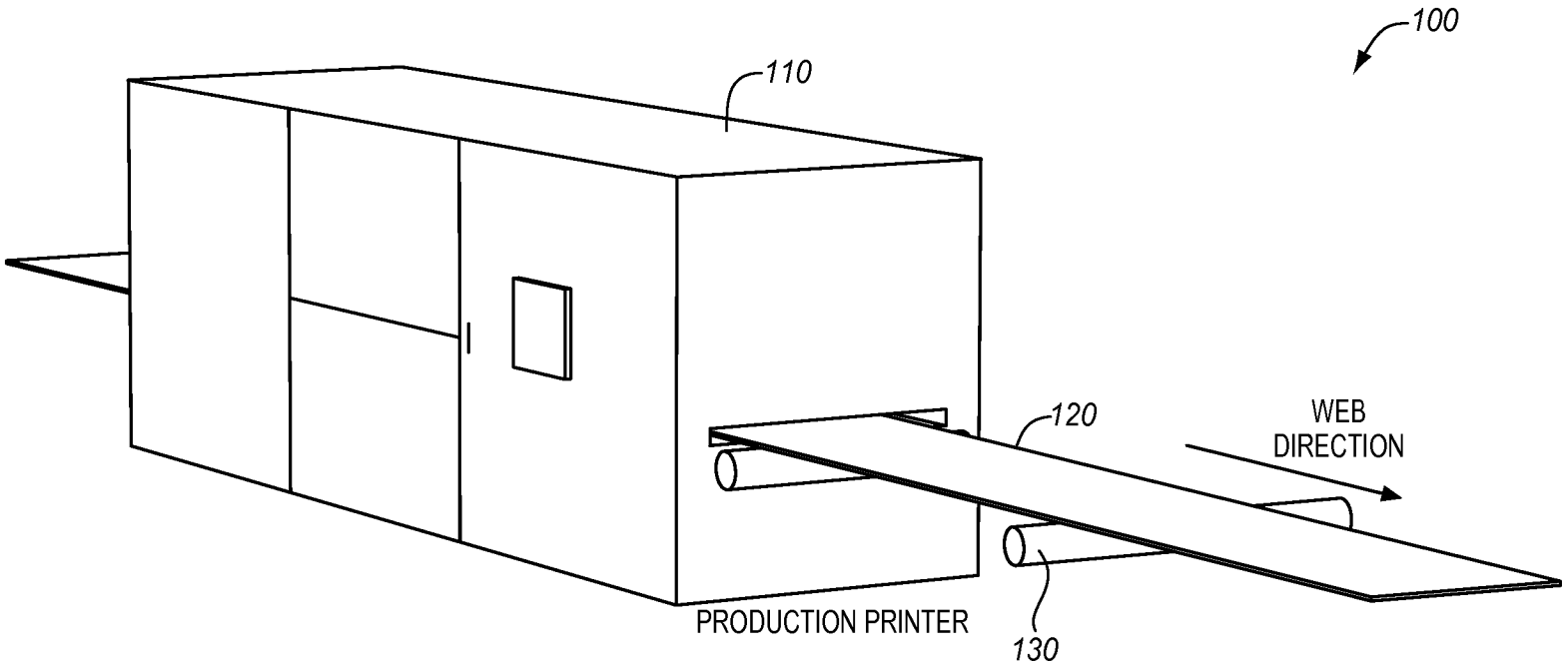
FIG. 1 illustrates an exemplary continuous-forms printing system.

FIG. 1 illustrates an exemplary continuous-forms printing system 100. Printing system 100 includes production printer 110, which is operable to apply ink onto a web 120 of continuous-form print media (e.g., paper). As used herein, the word "ink" is used to refer to any suitable marking fluid that can be applied by a printer (e.g., aqueous inks, oil-based paints, etc.). Printer 110 may comprise an inkjet printer that applies colored inks, such as Cyan (C), Magenta (M), Yellow (Y), and Key (K) black inks. One or more rollers 130 position web 120 as it travels through printing system 100.

Figure 2:
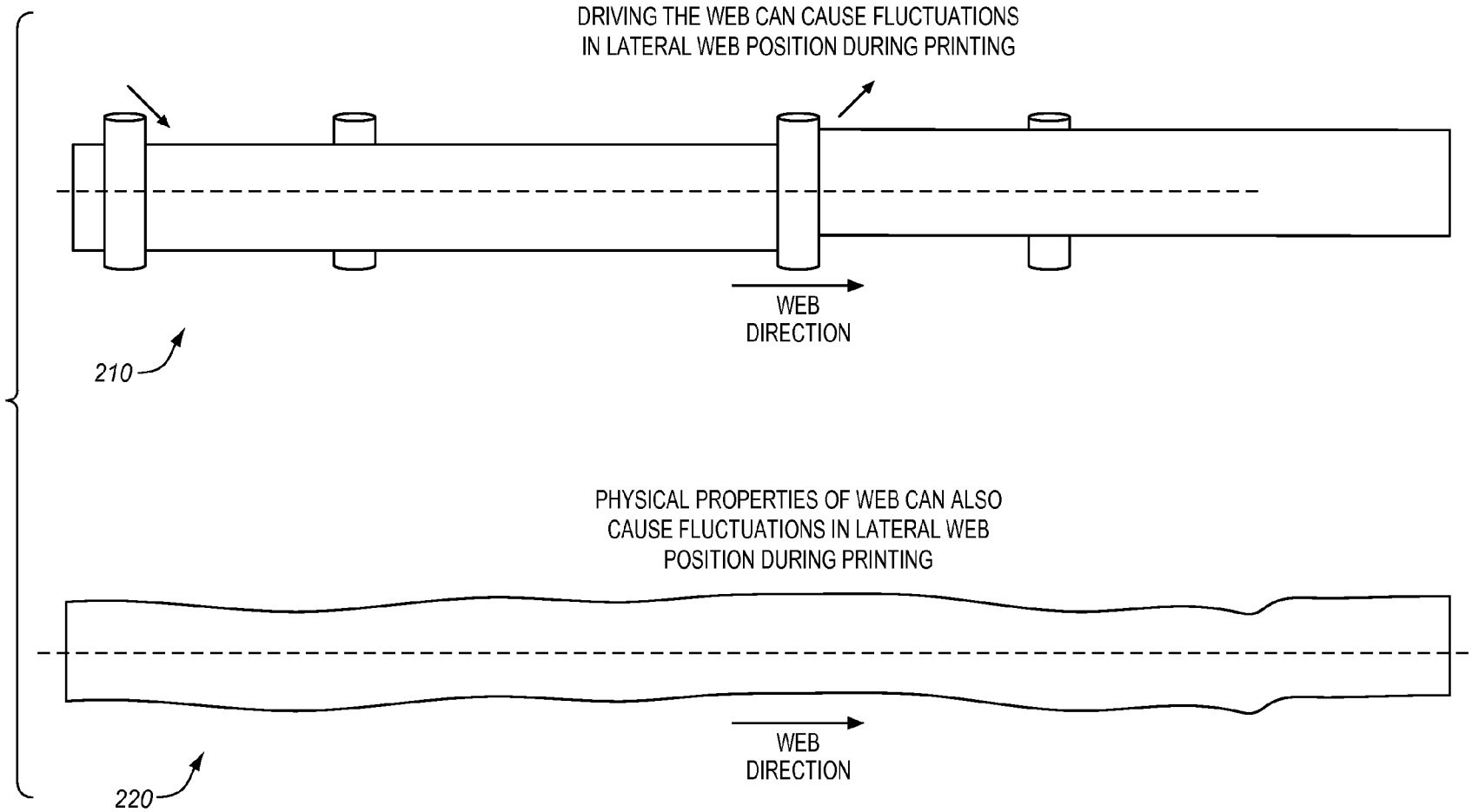
FIG. 2 illustrates how a web of print media can oscillate laterally within the printing system of FIG. 1 during printing.

FIG. 2 illustrates how a web of print media can shift laterally within the exemplary printing system of FIG. 1 during printing. For example, FIG. 2 at element 210 illustrates that rollers can impart lateral shifts to a web of print media. As used herein, a lateral shift is a change in position or tension that is within the plane of the web and orthogonal to the direction of travel of the web (i.e., orthogonal to the length of the web, and parallel to the width of the web).

As shown in element 210, before traveling through a roller the lateral position of the web (with respect to the web's direction of travel) is above the dashed reference line. After traveling through the roller, it is below the reference line. Furthermore, the degree of lateral shifting imparted by the printing system itself can oscillate in amplitude and direction while the printing system is operating. In short, the very act of driving the web can cause the web to laterally oscillate back and forth at a natural frequency. No static adjustments can compensate for these oscillating lateral shifts that occur during printing.

FIG. 2 at element 220 shows that the web itself can also contribute to lateral fluctuations. Element 220 shows that a web may have an uneven edge. For example, some webs of print media are initially cut with a blade. When a long cut is being made, the blade itself can oscillate laterally back and forth at a certain frequency by very small amounts (e.g., a few microns). This in turn imparts an uneven edge to the web. Since many printheads maintain the same absolute position while printing, the distance of printed marks relative to the edge of the paper will vary as the edge of the paper itself varies, which can reduce print quality.

Figure 3:
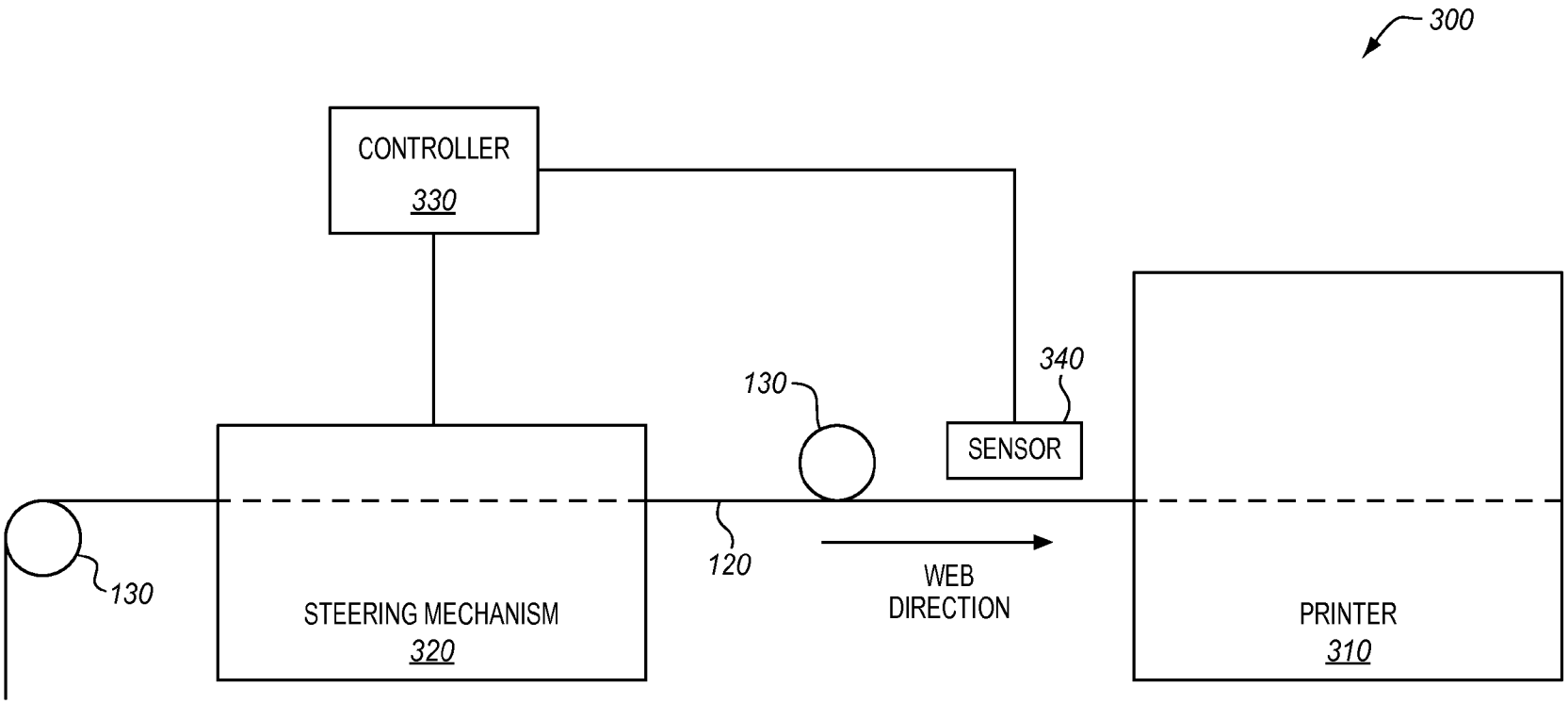
FIG. 3 is a block diagram illustrating an exemplary printing system that accounts for lateral shifts at a web of print media.

FIG. 3 is a block diagram illustrating an exemplary printing system 300 used to address the problems with shifting webs discussed above. Printing system 300 includes printer 310, which is capable of printing onto web 120, as well as rollers 130 which vertically position and tension web 120 during printing. Printing system 300 has been enhanced to predictively compensate for lateral shifts of web 120 during printing. Specifically, printing system 300 includes a steering mechanism 320, a controller 330, and a sensor 340 that can operate together to predictively adjust for lateral shifts of the web. Lateral shifts in web 120 can comprise changes in side-to-side tension or lateral position of the web during printing.

Sensor 340 comprises any system, component, or device operable to detect shifts in web 120. For example, sensor 340 can comprise a laser, pneumatic, photoelectric, ultrasonic, infrared, optical, or any other suitable type of sensing device. In one embodiment, sensor 340 comprises a physical sensor that can detect an amount of lateral force applied to it by web 120 during travel. Sensor 340 can be placed upstream of steering mechanism 320, or downstream of steering mechanism 320 as desired. In this context, the word "upstream" is used with respect to the direction of travel of web 120.

Controller 330 comprises any system, component, or device operable to control steering mechanism 320, based on lateral shifts detected by sensor 340. Controller 330 can perform frequency analysis of the lateral shifts, and can direct the operations of steering mechanism 320 based on the frequency analysis. Controller 330 can be implemented, for example, as custom circuitry, as a processor executing programmed instructions stored in an associated program memory, or some combination thereof.

Steering mechanism 320 comprises any system, component, or device operable to adjust the lateral position of web 120 during printing. For example, steering mechanism 320 may comprise an Edge Position Controller (EPC) of a continuous-forms printing system, a steering frame, a web-positioning module, etc.

Illustrative details of the operation of printing system 300 will be discussed with regard to FIG. 4. Assume, for this embodiment, that printing system 300 has started printing a print job. As a part of this process, web 120 has started traveling through printing system 300.

Figure 4:
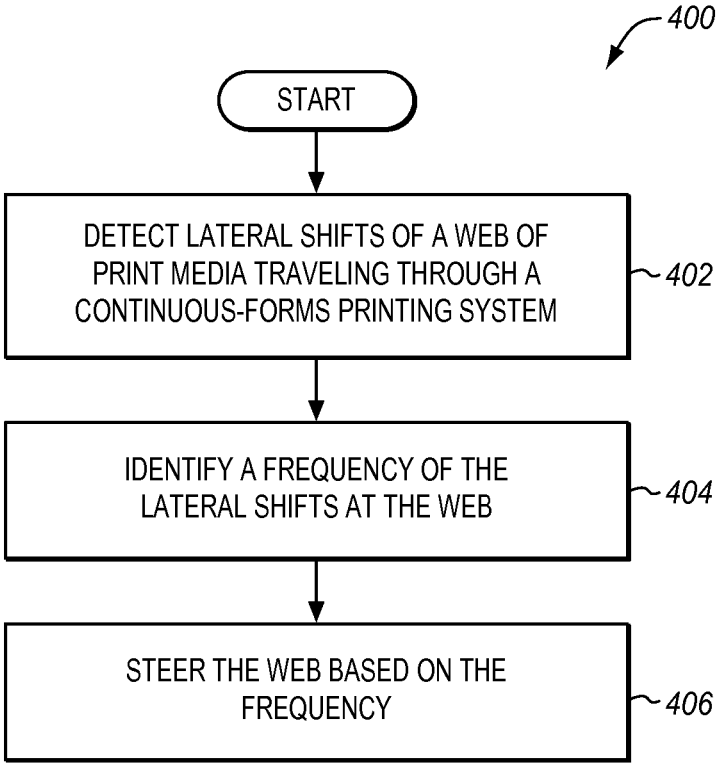
FIG. 4 is a flowchart illustrating an exemplary method of accounting for lateral shifts at a web of print media.

FIG. 4 is a flowchart illustrating an exemplary method of accounting for lateral shifts at a web of print media. The steps of method 400 are described with reference to printing system 300 of FIG. 3, but those skilled in the art will appreciate that method 400 may be performed in other systems. The steps of the flowcharts described herein are not all inclusive and may include other steps not shown. The steps described herein may also be performed in an alternative order.

In step 402, sensor 340 detects lateral shifts at web 120 as web 120 travels through printing system 300. The shifts can be measured changes in the lateral position of web 120 itself with respect to printing system 300, or can be measured changes in a lateral force applied by web 120 to sensor 340. The detected shifts at web 120 are provided to controller 330 for processing.

In step 404, controller 330 identifies a frequency of the laterals shifts of the web. This may comprise interpreting input from sensor 340 in the frequency domain, and then identifying one or more frequencies that the lateral shifts regularly occur at (e.g., the peak frequencies at which the most shifting occurs, and the phases for those frequencies). In one embodiment, entire frequency spectrums of shifting can be identified by controller 330. In a further embodiment, controller 330 applies a lowpass filter to the frequency domain data before controller 330 identifies these frequencies.

If web 120 has been continuously shifting its position laterally at identifiable frequencies, then web 120 can be predicted to continue its oscillating shifting behavior in the future. Therefore, in step 406, controller 330 steers the web by directing steering mechanism 320 based on the identified frequency, to predictively compensate for the shifts of the web.

For example, controller 330 can generate a compensating waveform made from sinusoids that oscillate at the identified frequencies. The compensating waveform indicates the predicted future lateral shifts of web 120 during printing. In order to compensate for these shifts, controller 330 can invert the waveform (i.e., phase shift the wave form by one hundred and eighty degrees) in order to create a complementary version that should cancel out the predicted shifts.

Controller 330 can then direct steering mechanism 320 to apply shifts to web 120 based on the inverted waveform in order to cancel out the future predicted shifts of web 120. Thus, when web 120 travels through printer 110, web 120 remains properly positioned with respect to the printheads. Without this predictive compensation, web 120 would wobble laterally from side to side, which would cause the output from printer 110 to appear inconsistent.

Method 400 may repeat multiple times during printing, and input from sensor 340 can be used to continuously identify and compensate for changing lateral shifts in web 120. This allows printing system 300 to prevent lateral shifts in web 120, even when the frequency or magnitude of the shifts changes over time.

In some embodiments, sensor 340 is not positioned at the same location as steering mechanism 320. In these embodiments, controller 330 can determine a "lag time" that it takes for the web to travel between steering mechanism 320 and sensor 340. Controller 330 can then alter the input to steering mechanism 320 based on the lag time, in order to ensure that steering mechanism 320 compensates for the expected motions of web 120 at the correct time.

In embodiments where sensor 340 is placed downstream from steering mechanism 320, input from sensor 340 can be used to determine whether applied corrections to the web are working as expected. Controller 330 can review input from sensor 340 after steering mechanism 320 has compensated for the lateral shifts of the web. If the input from sensor 340 shows that web 120 is still oscillating laterally, controller 330 can perform further adjustments to compensate for these oscillations.

In a further embodiment, additional sensors are used to predictively compensate for the motion of a web of print media. For example, a first sensor can be placed upstream of the steering mechanism, and a second sensor may be placed downstream of the steering mechanism. The upstream sensor can be used to measure the "natural" frequency of shifts of the web due to the normal operations of the printing system and the physical properties of the web. A controller can then direct the steering mechanism based on those identified frequencies.

The downstream sensor can measure shifts of the web that occur just before printing. If input from the downstream sensor shows that adjustments made by the steering mechanism are not sufficient, the controller may adjust the amplitude, frequency, or timing of the adjustments. For example, when multiple rollers are placed between the steering mechanism and the printer, the rollers may dampen steering applied by the steering mechanism. In such cases, the downstream sensor can detect that the web is still oscillating laterally prior to printing, and the controller can increase the amplitude of the applied steering to compensate for this issue.

EXAMPLES

In the following examples, additional processes, systems, and methods are described in the context of a printing system that predictively adjusts for oscillating lateral shifts at a web of print media.

Figure 5A:
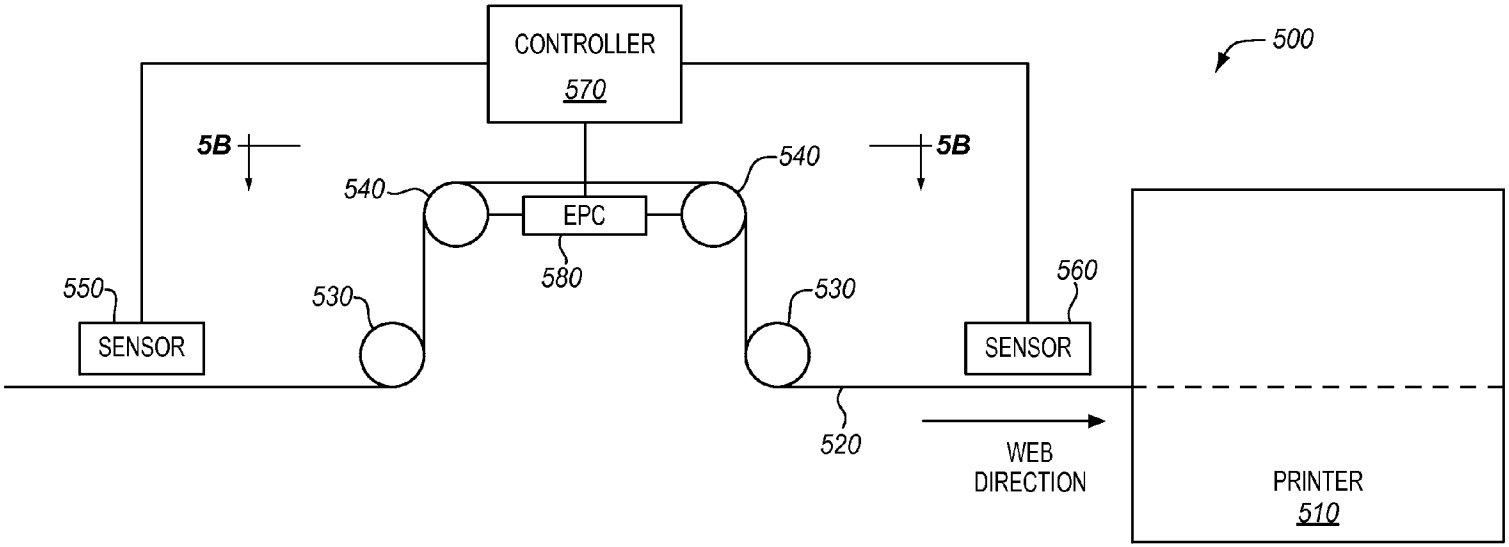
FIGS. 5A-B are block diagrams illustrating a further exemplary printing system that accounts for lateral shifts at a web of print media.

FIG. 5A is a block diagram illustrating a further exemplary printing system 500 that accounts for lateral shifts at a web of print media. FIG. 5A shows a side view of printing system 500, which includes a printer 510, web 520, and rollers 530 which are used to tension web 520. Printing system 500 further includes upstream sensor 550 and downstream sensor 560. Each of these sensors is a laser thru-beam edge position sensor that can accurately measure the lateral position of the web to within about five microns.

Figure 6:
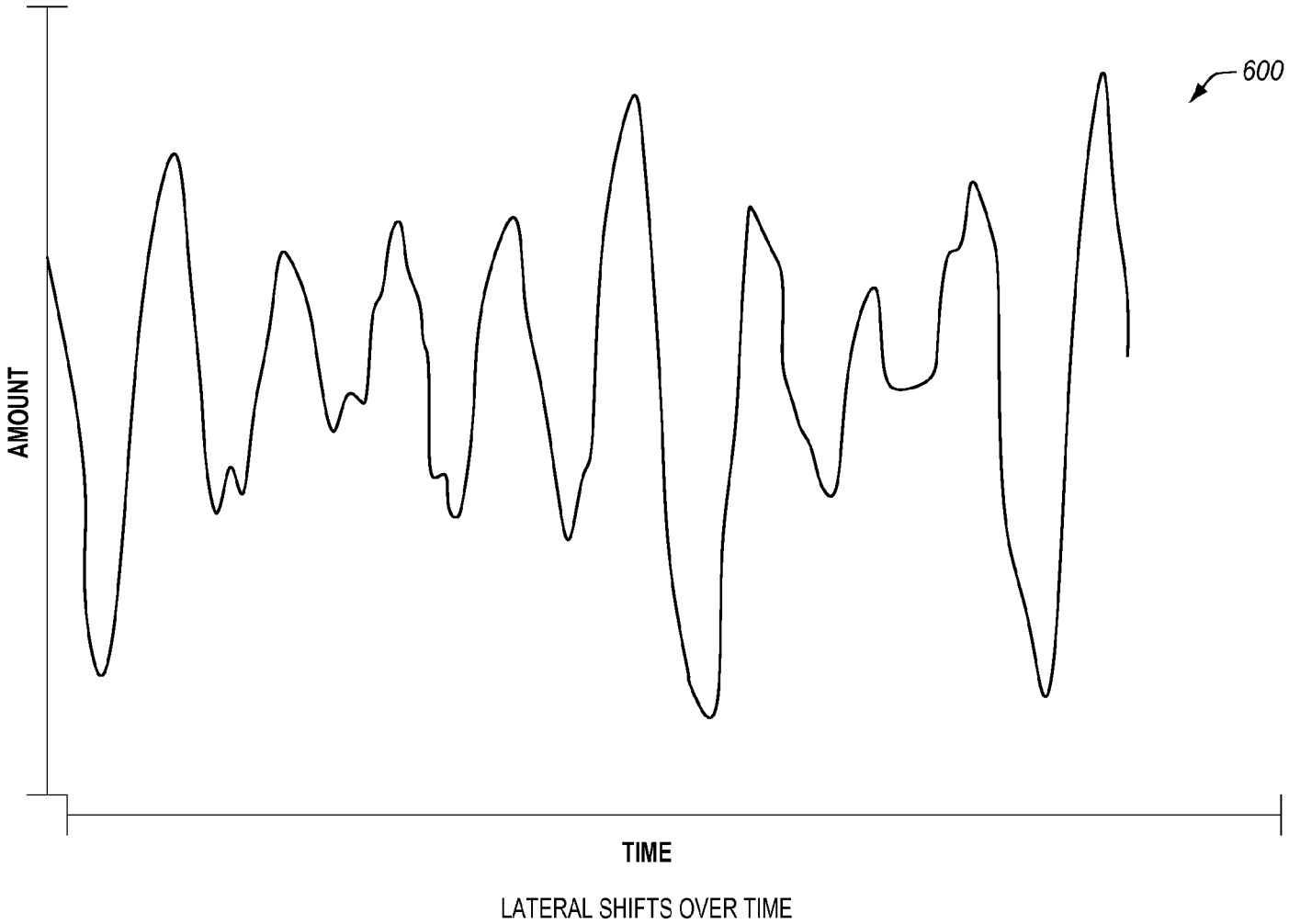
FIG. 6 is a graph illustrating exemplary measured lateral shifts at a web of print media.

The sensors send lateral position data to controller 570, which includes a processor and a memory. Controller 570 records a series of data points from sensor 550 over time for a period of several seconds. In this embodiment, since most periodic shifts of the web are expected to occur between frequencies of about 0.1 and 2 Hertz (Hz), data collection continues for multiple seconds in order to ensure that these frequencies can be accurately measured. These measured lateral shifts are illustrated in graph 600 of FIG. 6.

Figure 7:
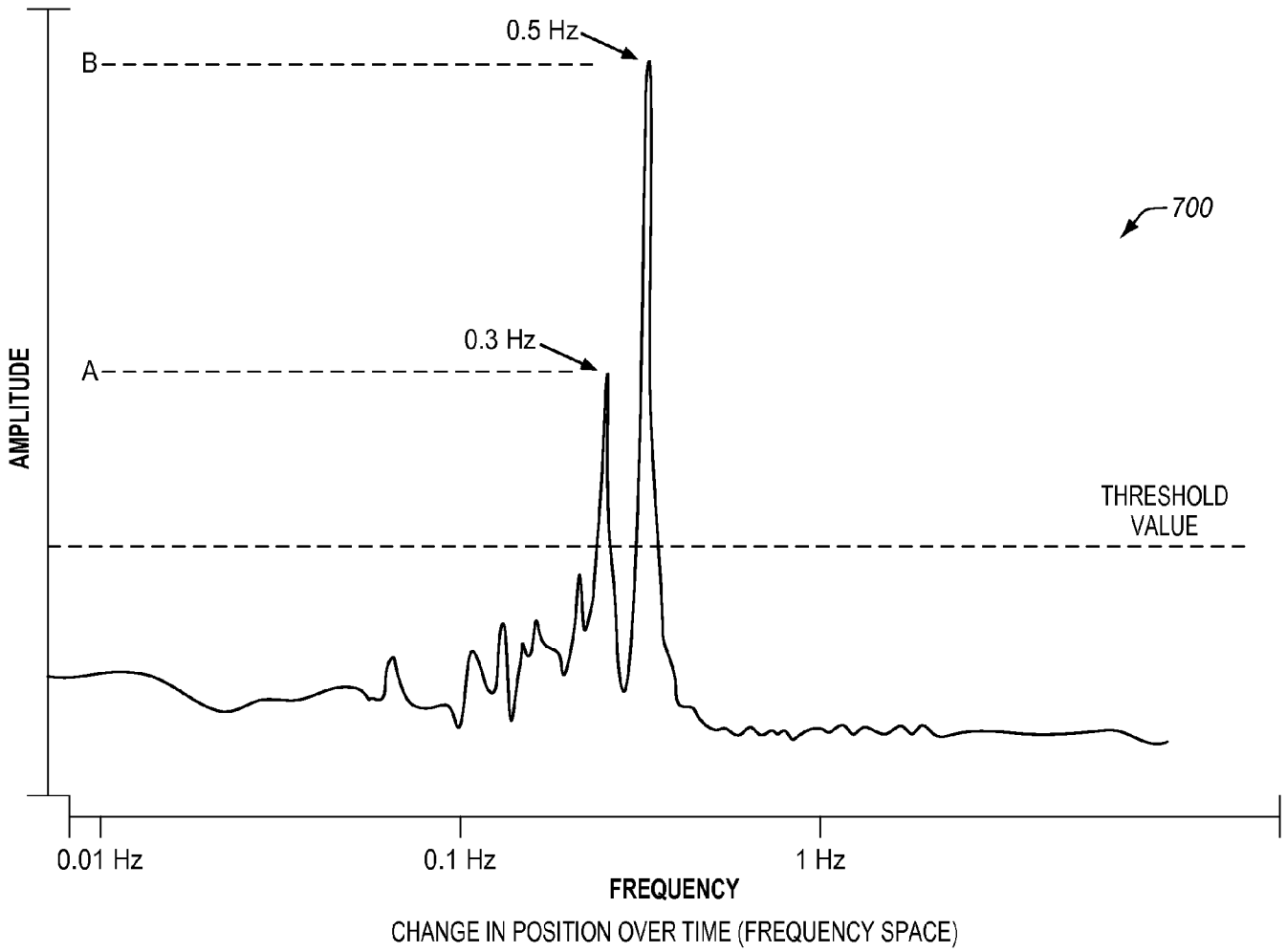
FIG. 7 is a graph illustrating an exemplary frequency domain analysis of the lateral shifts shown in FIG. 6.

Controller 570, upon receiving a sufficient amount of data, performs a Fourier transform on the position data to acquire a frequency domain representation of the lateral shifts in the position of web 520 over time. In order to filter out noise, controller 570 applies a lowpass filter that drops out frequencies which are higher than 2 Hz. FIG. 7 is a graph 700 illustrating the filtered frequency domain representation of the lateral shifts at web 520. Controller 570 reviews its internal memory to determine a threshold value for amplitude, and determines that threshold displacements of ten microns or more should be compensated for. Controller 570 therefore reviews the frequency domain data and determines that two frequency peaks (having a magnitude of A at 0.3 Hz, and a magnitude of B at 0.5 Hz with associated phases) cause more than the threshold level of lateral shifting. Controller 570 therefore predicts that future shifts will continue to occur at these frequencies.

Figure 8:
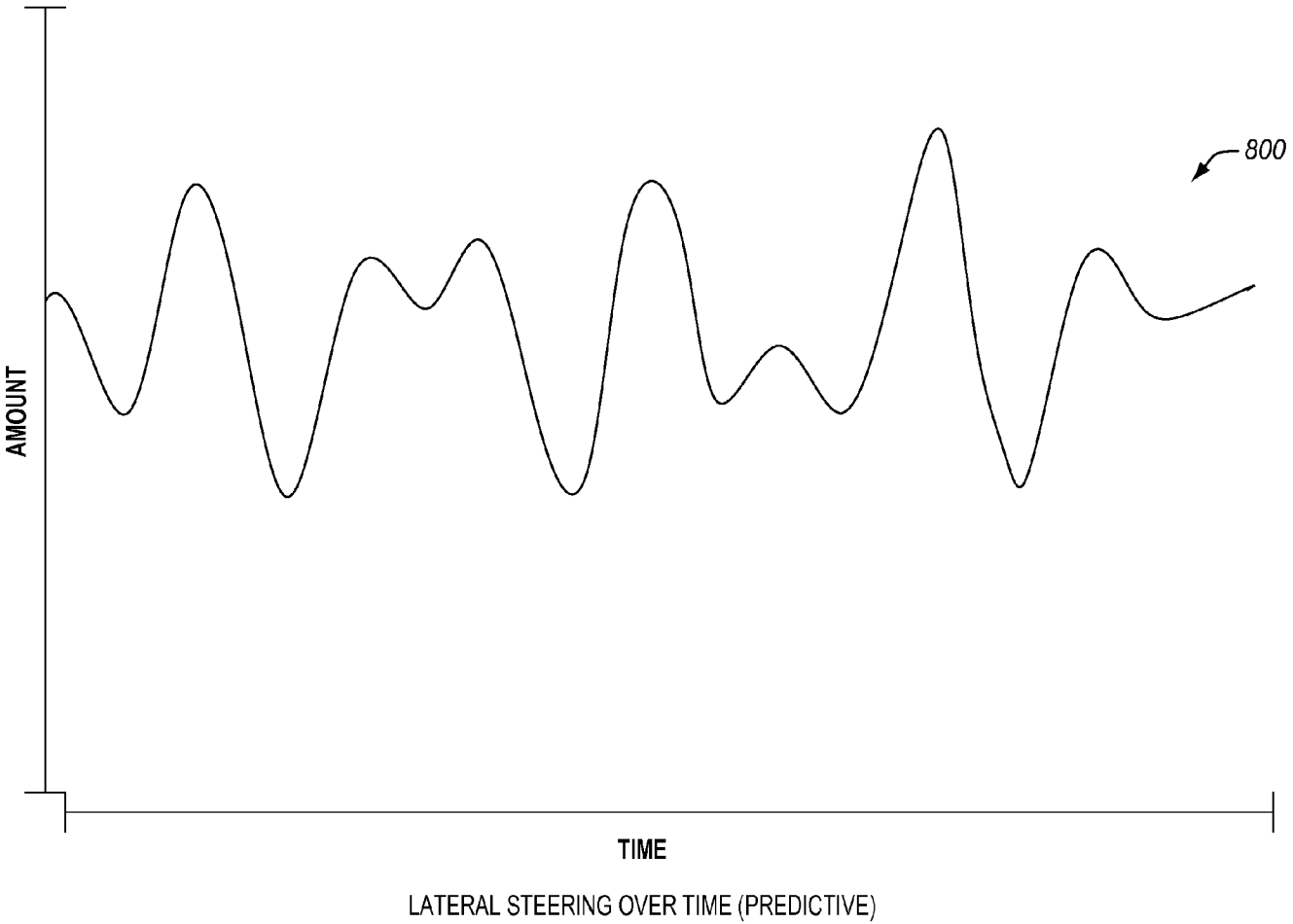
FIG. 8 is a graph illustrating an exemplary waveform generated to compensate for predicted future lateral shifts at a web of print media.

To address this predicted shifting, controller 570 generates a waveform pattern that matches the identified frequencies. In this case, accounting for the detected phases of the shifts, the waveform is $A*\sin(0.3x)+B*\sin(0.5x)$. FIG. 8 is a graph 800 illustrating the generated waveform.

Once the waveform has been generated, controller 570 decides what timing to use when compensating for the predicted shifts. Controller 570 therefore reviews the current speed of the printing system, which is seven feet per second. Based on this information and a known web travel distance of seven feet from sensor 550 to Edge Position Controller (EPC) 580, controller 570 delays the generated waveform by one second (with respect to the detected shifts) and then instructs EPC 580 to shift web 520 based on an inverted version of the waveform in order to compensate for future predicted shifts in web 520.

Figure 5B:
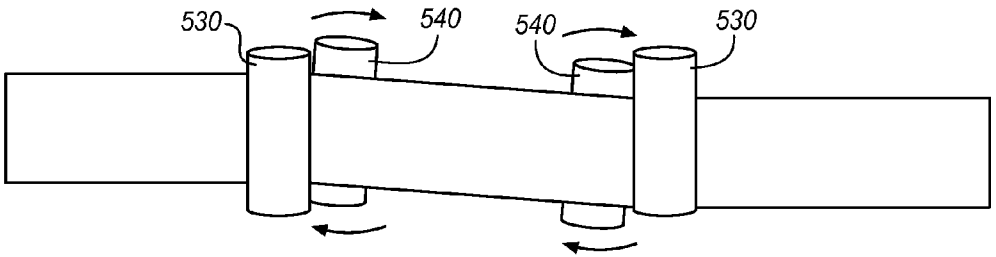

A top view of EPC 580 is shown in FIG. 5B beneath the side view of EPC 580 to illustrate how EPC 580 operates. The top view shows that EPC 580 can adjust the orientation of rollers 540, which in turn can steer web 520 laterally as desired.

Sensor 560 can measure the lateral position of web 520 after it has been laterally repositioned by EPC 580. Sensor 560 sends positional feedback data to controller 570, which reviews the data to determine whether further adjustments should be performed at this time. Controller 570 may then amplify, shift, or otherwise modify the directions that it sends to EPC 580.

Figure 9:
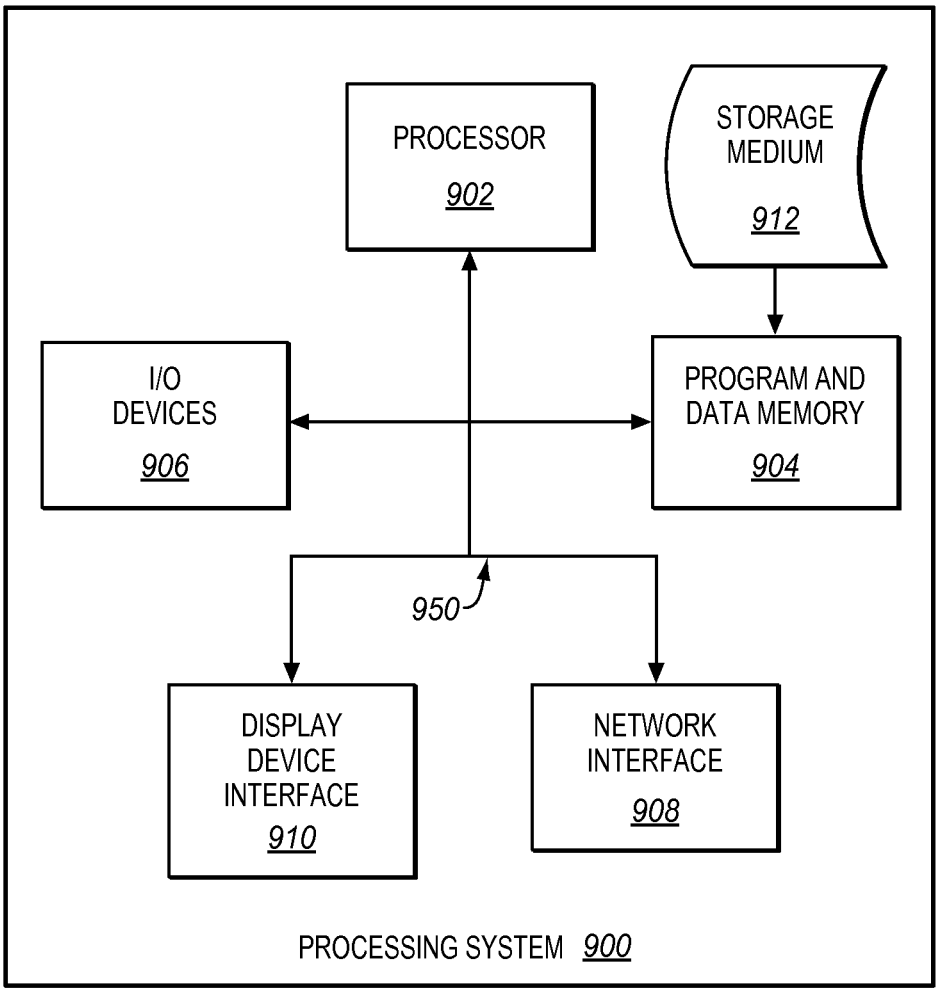
FIG. 9 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of controller 330 to perform the various operations disclosed herein. FIG. 9 illustrates a processing system 900 operable to execute a computer readable medium embodying programmed instructions to perform desired functions in an exemplary embodiment. Processing system 900 is operable to perform the above operations by executing programmed instructions tangibly embodied on computer readable storage medium 912. In this regard, embodiments of the invention can take the form of a computer program accessible via computer-readable medium 912 providing program code for use by a computer or any other instruction execution system. For the purposes of this description, computer readable storage medium 912 can be anything that can contain or store the program for use by the computer.

Computer readable storage medium 912 can be an electronic, magnetic, optical, electromagnetic, infrared, or semiconductor device. Examples of computer readable storage medium 912 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 900, being suitable for storing and/or executing the program code, includes at least one processor 902 coupled to program and data memory 904 through a system bus 950. Program and data memory 904 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 906 (including but not limited to keyboards, displays, pointing devices, etc.) can be coupled either directly or through intervening I/O controllers. Network adapter interfaces 908 may also be integrated with the system to enable processing system 900 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 910 may be integrated with the system to interface to one or more display devices, such as printing systems and screens for presentation of data generated by processor 902.

Although specific embodiments were described herein, the scope of the invention is not limited to those specific embodiments. The scope of the invention is defined by the following claims and any equivalents thereof.

We claim:

1. A system comprising:

a sensor operable to detect lateral shifts of a web of print media traveling through a continuous-forms printer; and a controller operable to identify a frequency of the lateral shifts of the web, and to steer the web based on the frequency.

2. The system of claim 1, wherein:

the controller is further operable to predict undetected shifts of the web based on the identified frequency, and to steer the web to predictively compensate for the predicted shifts of the web by generating opposed shifts at the frequency.

3. The system of claim 1, wherein:

the controller steers the web by directing a lateral web steering mechanism; and the controller is further operable to identify a lag time for the web to travel between the sensor and the steering mechanism, and to predictively compensate for the shifts of the web by generating opposed shifts based on the frequency and the lag time.

4. The system of claim 1, wherein:

the controller is further operable to identify the frequency by identifying a threshold level of shift amplitude, and identifying a frequency having a shift amplitude that is greater than the threshold level.

5. The system of claim 1, wherein:

the sensor is operable to detect lateral shifts in a position of the web with respect to the printer.

6. The system of claim 1, wherein:

the sensor is operable to detect lateral shifts in a side-to-side tension of the web with respect to the printer.

7. The system of claim 1, wherein:

the controller is operable to steer the web by directing a lateral web steering mechanism;

the sensor is located upstream of the steering mechanism; and the system further comprises an additional sensor that is located downstream of the steering mechanism;

wherein the controller is further operable to receive feedback from the additional sensor, and to further direct the steering mechanism based on the feedback from the additional sensor.

8. The system of claim 1, wherein:

the controller is further operable to apply a lowpass filter to data from the sensor prior to identifying the frequency.

9. A method comprising:

detecting lateral shifts at a web of print media traveling through a continuous-forms printer;

identifying a frequency of the lateral shifts of the web; and steering the web based on the frequency.

10. The method of claim 9, further comprising:

predicting undetected shifts of the web based on the identified frequency; and steering the web to predictively compensate for the predicted shifts of the web by generating opposed shifts at the frequency.

11. The method of claim 9, wherein:

steering the web comprises directing a lateral web steering mechanism, and the method further comprises:

identifying a lag time for the web to travel between a sensor detecting the shifts and the steering mechanism; and predictively compensating for the shifts of the web by generating opposed shifts based on the frequency and the lag time.

12. The method of claim 9, further comprising:

identifying the frequency by:

identifying a threshold level of shift amplitude; and identifying a frequency having a shift amplitude that is greater than the threshold level.

13. The method of claim 9, further comprising:

detecting lateral shifts in a position of the web with respect to the printer.

14. The method of claim 9, further comprising:

detecting lateral shifts in a side-to-side tension of the web with respect to the printer.

15. The method of claim 9, wherein:

steering the web comprises directing a lateral web steering mechanism;

detecting the lateral shifts is performed by a sensor located upstream of the steering mechanism; and the method further comprises:

receiving feedback from an additional sensor downstream of the steering mechanism; and directing the steering mechanism based on the feedback from the additional sensor.

16. The method of claim 9, further comprising:

applying a lowpass filter to the detected shifts prior to identifying the frequency.

17. A non-transitory computer readable medium embodying programmed instructions which, when executed by a processor, are operable for performing a method comprising:

detecting lateral shifts at a web of print media traveling through a continuous-forms printer;

identifying a frequency of the lateral shifts of the web; and steering the web based on the frequency.

18. The medium of claim 17, wherein the method further comprises:

predicting undetected shifts of the web based on the identified frequency;

steering the web to predictively compensate for the predicted shifts of the web by generating opposed shifts at the frequency.

19. The medium of claim 17, wherein:

steering the web comprises directing a lateral web steering mechanism, and the method further comprises:

identifying a lag time for the web to travel between a sensor detecting the shifts and the steering mechanism; and predictively compensating for the shifts of the web by generating opposed shifts based on the frequency and the lag time.

20. The medium of claim 17, wherein the method further comprises:

identifying the frequency by:

identifying a threshold level of shift amplitude; and identifying a frequency having a shift amplitude that is greater than the threshold level.

21. The medium of claim 17, wherein the method further comprises:

detecting lateral shifts in a position of the web with respect to the printer.

22. The medium of claim 17, wherein the method further comprises:

detecting lateral shifts in a side-to-side tension of the web with respect to the printer.

23. The medium of claim 17, wherein:

steering the web comprises directing a lateral web steering mechanism;

detecting the lateral shifts is performed by a sensor located upstream of the steering mechanism; and the method further comprises:

receiving feedback from an additional sensor downstream of the steering mechanism; and directing the steering mechanism based on the feedback from the additional sensor.

24. The medium of claim 17, wherein the method further comprises:

applying a lowpass filter to the detected shifts prior to identifying the frequency.

* * * * *